US009756909B1

(12) United States Patent
Bonner

(10) Patent No.: US 9,756,909 B1
(45) Date of Patent: Sep. 12, 2017

(54) JEWELRY RING

(71) Applicant: Robert Jason Bonner, Miramar, FL (US)

(72) Inventor: Robert Jason Bonner, Miramar, FL (US)

(73) Assignee: National Chain Company, Warwick, RI (US)

( * ) Notice: Subject to any disclaimer, the term of this patent is extended or adjusted under 35 U.S.C. 154(b) by 0 days.

(21) Appl. No.: 15/287,872

(22) Filed: Oct. 7, 2016

Related U.S. Application Data

(60) Provisional application No. 62/243,283, filed on Oct. 19, 2015, provisional application No. 62/243,278, filed on Oct. 19, 2015.

(51) Int. Cl.
*A44C 9/00* (2006.01)
*A44C 17/02* (2006.01)

(52) U.S. Cl.
CPC ..... *A44C 17/0233* (2013.01)

(58) Field of Classification Search
CPC ..... A44C 13/00; A44C 9/0007; A44C 9/0015; A44C 9/0023; A44C 9/02; A44C 9/0053; A44C 9/0061; A44C 17/02; A44C 17/0208; A44C 17/0216; A44C 17/0233; A44C 17/0225; A44C 9/0046
USPC ..... 63/15.45, 15.5, 15.6, 15.65
See application file for complete search history.

(56) References Cited

U.S. PATENT DOCUMENTS 2,316,225 A * 4/1943 De Hoffmann .... A44C 17/0216 63/15

FOREIGN PATENT DOCUMENTS

IN WO 2012056388 A1 * 5/2012 ..... A44C 17/0233

* cited by examiner

*Primary Examiner* — Jack W Lavinder
(74) *Attorney, Agent, or Firm* — Salter & Michaelson

(57) ABSTRACT

A jewelry product for wearing on the finger includes an annular member with a receiving passage that is meant to be engaged with the finger. The annular member includes a circular top portion that is integral with a base portion, said base portion being provided with the passage for engagement with the finger, and the circular top portion having a central aperture extending in the direction of the passage, and a circular mounting member for engagement over and with the circular top portion of the annular member. Interengageable threads are disposed between the circular mounting member and the circular top portion so as to enable the circular mounting member to be secured with or removed from the circular top portion of the annular member.

11 Claims, 5 Drawing Sheets

JEWELRY RING

RELATED APPLICATIONS

Priority for this application is hereby claimed under 35 U.S.C. §119(e) to commonly owned U.S. Provisional Patent Application Nos. 62/243,283 and 62/243,278 which were both filed on Oct. 19, 2015 and each of which is incorporated by reference herein in its entirety.

FIELD OF THE INVENTION

The present invention relates in general to a jewelry product in the form of a jewelry ring for wearing on the finger. More particularly, the present invention relates to an improvement in the jewelry ring to enable an interchange of different head constructions of the jewelry ring.

BACKGROUND OF THE INVENTION

There are a great number of different jewelry ring constructions that are available. However, the existing constructions do not allow for an interchangeability of at least a portion of the jewelry ring. This interchangeability, in accordance with the present invention, enables the ring structure to have different mounting pieces so as to display different types of jewelry items.

Accordingly, it is an object of the present invention to provide a jewelry product for wearing on the finger of a user having an annular member that supports a circular mounting piece that can be interchanged with other mounting pieces.

Another object of the present invention is to provide an improved jewelry product in which the mounting piece is interchangeable with the preferred use of interengageable threads.

SUMMARY OF THE INVENTION

To accomplish the foregoing and other objects, features and advantages of the present invention there is provided a jewelry product for wearing on the finger and comprised of an annular member with a receiving passage that is meant to be engaged with the finger. The annular member includes a circular top portion that is integral with a base portion, said base portion being provided with the passage for engagement with the finger, and the circular top portion having a central aperture extending in the direction of the passage, and a circular mounting member constructed and arranged for engagement over and with the circular top portion of the annular member. Inter-engageable threads are disposed between the circular mounting member and the circular top portion so as to enable the circular mounting member to be secured with or removed from the circular top portion.

In accordance with other aspects of the present invention the inter-engageable threads include a thread section on an outer surface of the circular top portion and a threaded section on an inner surface of the circular mounting member; the inter-engageable threads include a thread section on an outer surface of the circular top portion and a threaded section on an inner surface of the circular mounting member; the circular top portion has a central aperture, and further including a decorative piece supported by the circular mounting member; the decorative piece is supported by a set of prongs, the circular top portion has a substantially flat top surface in which the central aperture is formed and which support the set of prongs, and the decorative piece overlies the central aperture; a bottom side of the decorative piece extends down into the central aperture; including a series of decorative gems supported at the circular mounting member and disposed in a circular pattern about the decorative piece; the circular mounting member has a slanted top wall having spaced apart recesses for accommodating respective decorative gems; the prongs are disposed vertically relative to the flat surface and are arranged between the decorative piece and the series of decorative gems; and the slanted surface is disposed entirely about the decorative piece and is disposed at an acute angle to the flat surface.

In an alternate embodiment the inter-engageable threads include a thread section on an inner surface of the circular top portion and a threaded section on an outer surface of the circular mounting member; the circular mounting member has a top recess, and further including a decorative piece supported by the circular mounting member in the top recess; the circular top portion has a center recess with internal threads; the circular mounting member has a downwardly extending post that is externally threaded for engagement with the internal threads of the center recess; the decorative piece is supported by a set of prongs and the decorative piece overlies the downwardly extending post; the downwardly extending post defines an annular slot into which the circular top portion threads; including a series of decorative gems supported at the circular mounting member and disposed in a circular pattern about the decorative piece; the circular mounting member has a slanted top wall having spaced apart recesses for accommodating respective decorative gems; the prongs are disposed vertically and are arranged between the decorative piece and the series of decorative gems; and the top recess has a flat bottom wall and the prongs are supported from the flat bottom wall.

BRIEF DESCRIPTION OF THE DRAWINGS

It should be understood that the drawings are provided for the purpose of illustration only and are not intended to define the limits of the disclosure. In the drawings depicting the present invention, all dimensions are to scale. The foregoing and other objects and advantages of the embodiments described herein will become apparent with reference to the following detailed description when taken in conjunction with the accompanying drawings in which.

DETAILED DESCRIPTION

Figure 1:
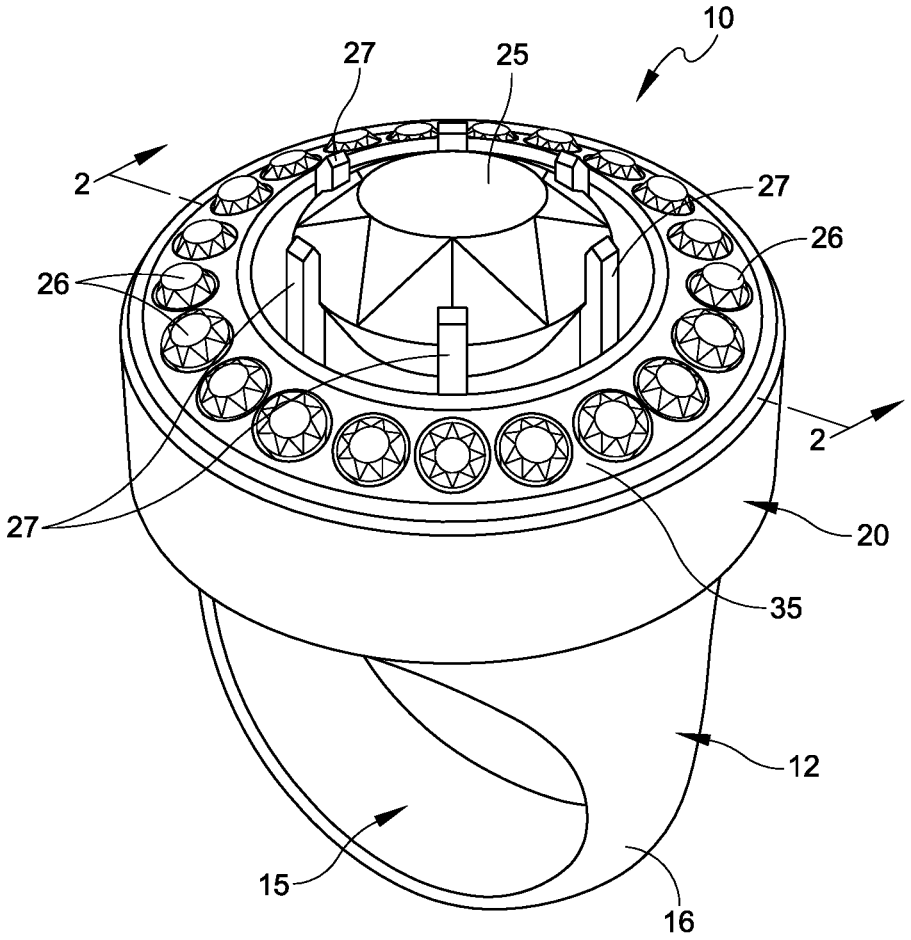
FIG. 1 is a perspective view of a first embodiment of the jewelry ring of the present invention.

Reference is now made to a first embodiment of the present invention illustrated in FIGS. 1-4. This jewelry product is comprised of an annular member 12 having a receiving passage 15 that is meant to be engaged with the finger, or possibly the toe, of the user. The annular member 12 includes a circular or cylindrical top portion 14 as depicted in the cross-sectional view of FIG. 2. The circular or cylindrical top portion 14 is integrally formed with the base portion 16. The base portion 16 is the portion that is provided with the passage 15 for receiving the finger or toe or possibly a chain link or other filament type piece. The circular top portion 14 has a central aperture 17 that extends generally toward the passage 15 leaving a thin wall at 19 defined over the passage 15.

Figure 3:
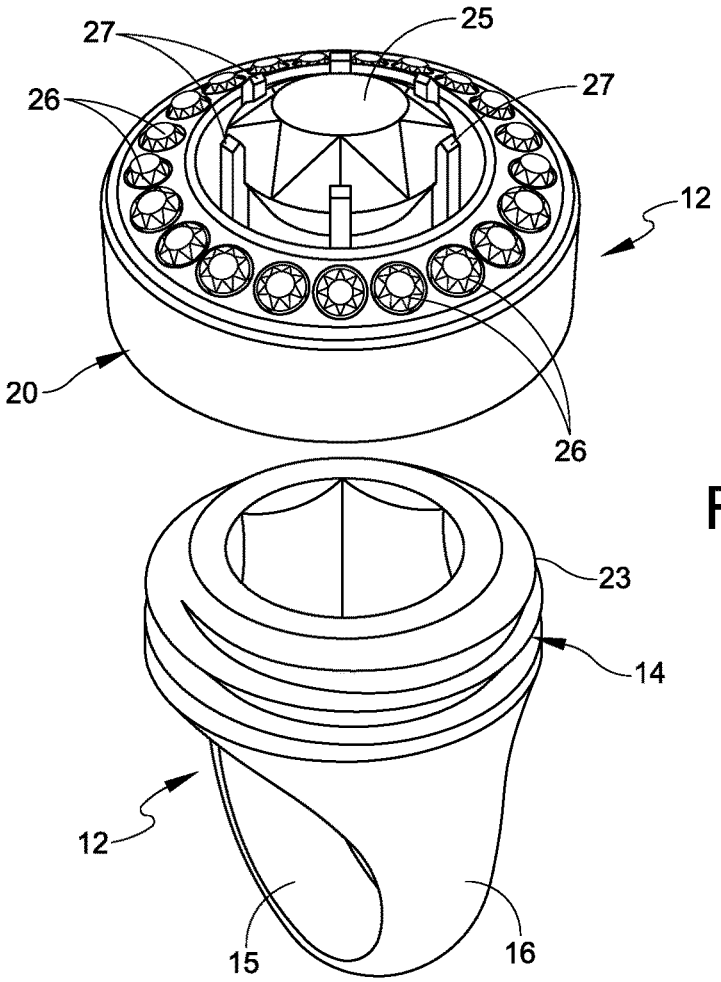
FIG. 3 is an exploded view of the embodiment illustrated in FIGS. 1 and 2 and including a base annular member and an overlying circular mounting member.
Figure 4:
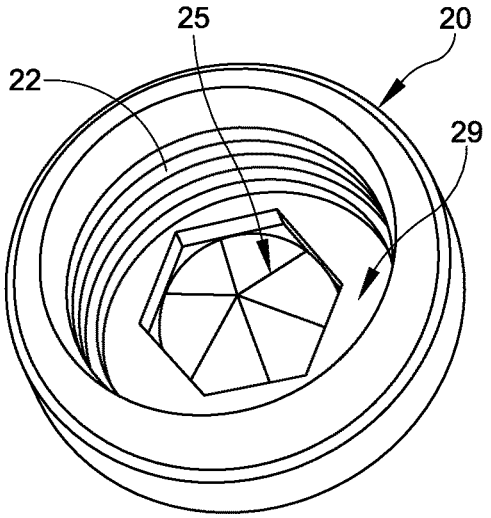
FIG. 4 is an underside view of the mounting member.

To provide for the interchangeability of the jewelry items, there is provided a circular mounting member 20 that is constructed and arranged for engagement over and with the circular or cylindrical top portion 14. For this purpose there are provided interengageable threads 22 and 23. FIG. 3 illustrates the threads 23 on an outer surface of the circular or cylindrical top portion 14 and FIG. 4 illustrates the internal threads at 22 disposed within the recess 29 of the circular or cylindrical mounting member 20.

Figure 2:
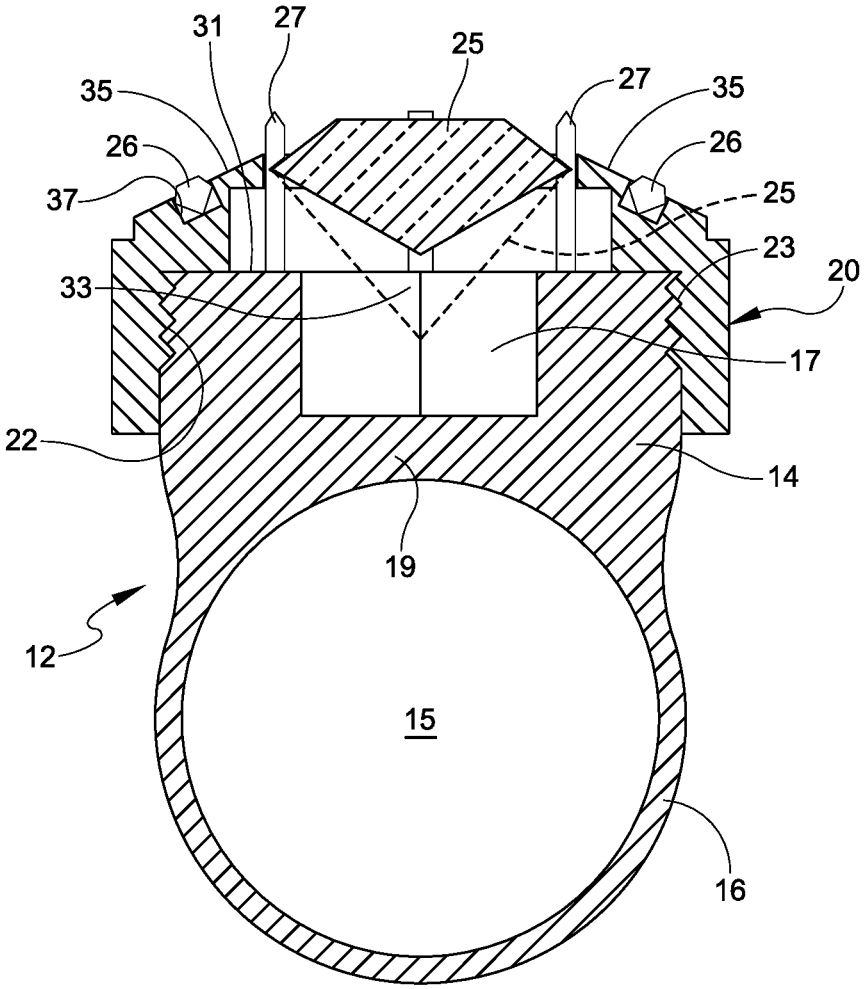
FIG. 2 is a cross-sectional view taken along line 2-2 of FIG. 1.

FIGS. 1 and 2 illustrate the circular mounting member 20 threaded onto the circular top portion 14 of the annular member 12. FIG. 3 illustrates the circular or cylindrical mounting member 20 threaded off of the circular or cylindrical top portion 14. The circular mounting member 20 mounts, in this particular embodiment, a gem 25 that is supported by a plurality of circumferentially disposed prongs 27. Also, about the periphery of the circular mounting member 20, there are preferably provided a series of smaller gems 26.

In the cross-sectional view of FIG. 2 there are provided a plurality of parallel arranged prongs 27 each extending substantially vertically from a surface 31. Each of the prongs 27 may be provided with a slot for receiving an edge of the gem 25. In FIG. 2 the gem 25 is shown in solid outline as being disposed completely above the flat surface 31. In an alternate arrangement, as shown in dotted outline in FIG. 2, a bottom side of the gem 25, at 33, is illustrated as extending into the central aperture 17 in the circular or cylindrical top portion 14. Thus, the central aperture 17 allows additional space in order to accommodate a larger gem 25, as shown in dotted outline in FIG. 2. Also, each of the smaller gems 26 are mounted in a small recess 37, as also illustrated in FIG. 2. This small recess is disposed in a slanted wall 35. Both the gem 26 and recess 37 may be circular in shape. The arrangement is such that the prongs 27 are essentially disposed between the central single gem 25 and the myriad of smaller gems 26. The number of smaller gems 26 is significantly greater than the number of prongs. Refer to FIG. 1 showing on the order of 20 smaller gems 26. The number of prongs 27 may be six.

Figure 5:
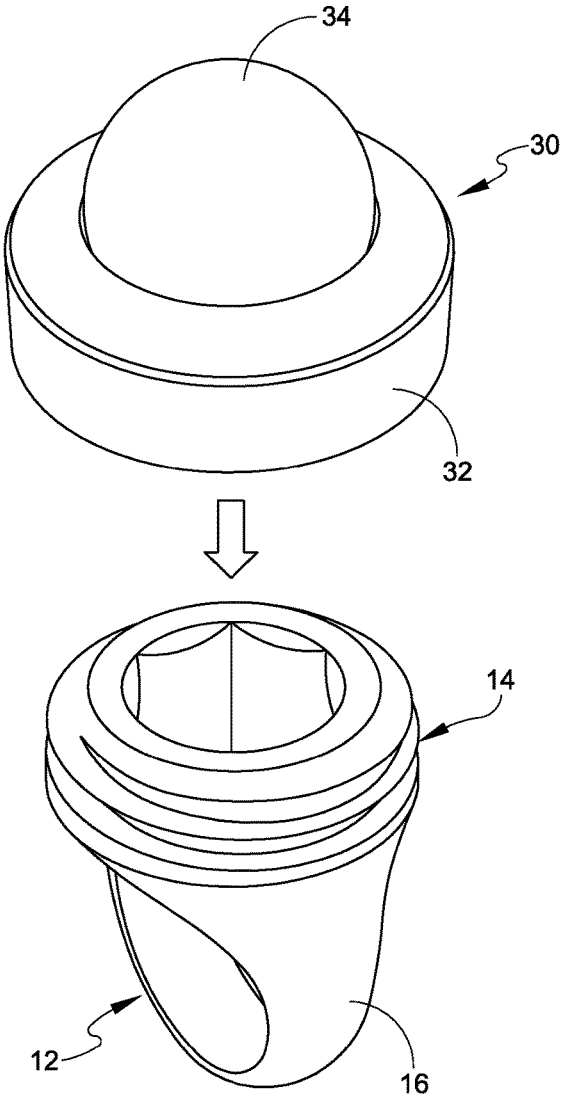
FIG. 5 is an exploded perspective view of a second embodiment of the jewelry ring of the present invention.
Figure 6:
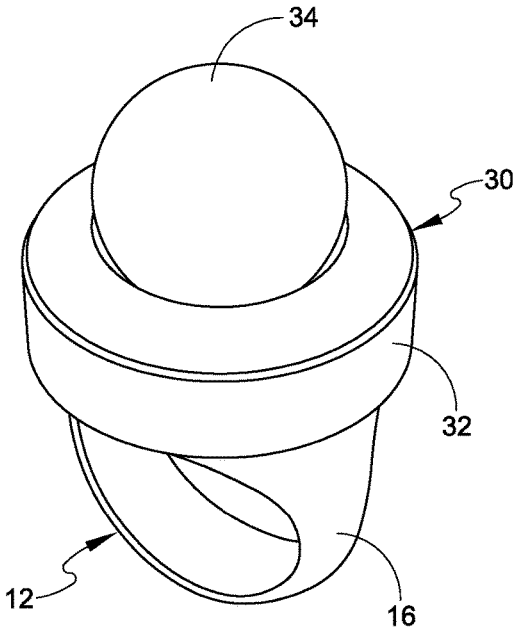
FIG. 6 is a perspective view of the embodiment illustrated in FIG. 5 with the separate pieces screwed together.

Reference is now made to another embodiment of the present invention illustrated in FIGS. 5 and 6. This also includes an annular member 12 that may be substantially identical to the one illustrated in FIGS. 1-4. The mounting member 30 is different than that illustrated in FIGS. 1-4 and includes a base 32 and a supported gem or decoration 34. The base 32 would be provided with internal threads such as the threads 22 depicted in FIGS. 2 and 4. The annular member 12 may be substantially the same as illustrated in FIG. 3.

Figure 7:
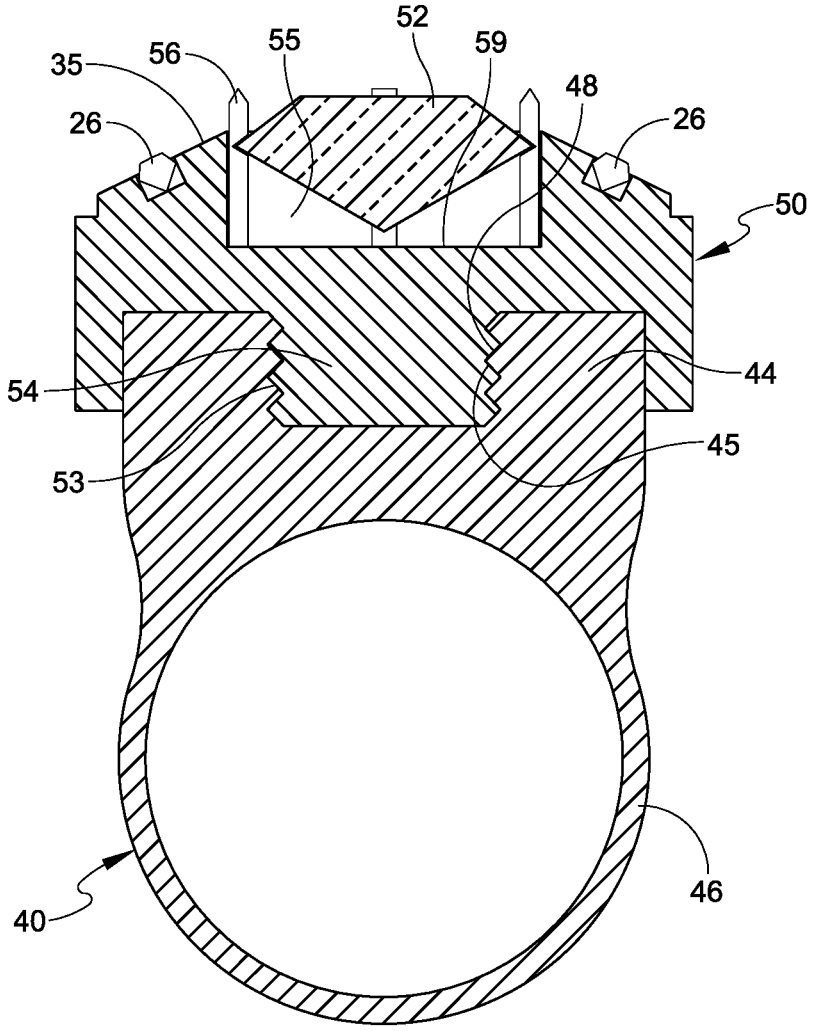
FIG. 7 is a cross-sectional view of an alternate embodiment of the jewelry ring of the present invention.

Reference is now also made to an alternate embodiment of the present invention illustrated in the cross-sectional view of FIG. 7. In this embodiment, there is provided an annular member 40 having a base portion 46 and an integral circular or cylindrical top portion 44. The top portion 44 is provided with a recess 48 having internal threads 45. The circular mounting member 50 supports a gem 52 and also has a downwardly depending support post 54 with external threads 53. The downwardly extending post 54 defines an annular slot thereabout into which the circular top portion 44 threads, as illustrated in FIG. 7. The mounting member 50 may be threaded on to and off of the top portion 44.

The mounting member 50 also has a top recess 55 into which the gem 52 rests. Prongs 56 are also illustrated for the mounting of the gem 52 in a similar manner as previously discussed. FIG. 7 also shows a series of smaller gems at 26 similar to that previously depicted in, for example, FIGS. 1 and 2, including a corresponding small recess for accommodating each of the smaller gems 26 in a corresponding recess. The prongs 56 are disposed vertically and are arranged between the decorative piece 52 and the series of decorative gems 26. The top recess 55 has a flat bottom wall 59 and the prongs 56 are supported from that flat bottom wall.

Having now described a limited number of embodiments of the present invention, it should now be apparent to those skilled in the art that numerous other embodiments and modifications thereof are contemplated as falling within the scope of the present invention, as defined by the appended claims.

What is claimed is:

1. A jewelry product for wearing on the finger and comprised of an annular member with a receiving passage that is meant to be engaged with the finger, said annular member including a circular top portion that is integral with a base portion, said base portion being provided with the passage for engagement with the finger, and the circular top portion having a central aperture extending in the direction of the passage, and a circular mounting member constructed and arranged for engagement over and with the circular top portion of the annular member;

including inter-engageable threads disposed between the circular mounting member and the circular top portion so as to enable the circular mounting member to be secured with or removed from the circular top portion;

wherein the inter-engageable threads includes a thread section on an outer surface of the circular top portion and a threaded section on an inner surface of the circular mounting member;

wherein the circular top portion has a central aperture, and further including a decorative piece supported by the circular mounting member;

wherein the decorative piece is supported by a set of prongs, the circular top portion has a substantially flat top surface in which the central aperture is formed and which support the set of prongs, and the decorative piece overlies the central aperture.

2. The jewelry product of claim 1 wherein a bottom side of the decorative piece extends down into the central aperture.

3. The jewelry product of claim 1 including a series of decorative gems supported at the circular mounting member and disposed in a circular pattern about the decorative piece.

4. The jewelry product of claim 3 wherein the circular mounting member has a slanted top wall having spaced apart recesses for accommodating respective decorative gems.

5. The jewelry product of claim 4 wherein the prongs are disposed vertically relative to the flat surface and are arranged between the decorative piece and the series of decorative gems.

6. The jewelry product of claim 5 wherein the slanted surface is disposed entirely about the decorative piece and is disposed at an acute angle to the flat surface.

7. The jewelry product of claim 1 wherein the circular mounting member has a slanted top wall having spaced apart recesses.

8. The jewelry product of claim 7 including a series of decorative gems received in said respective spaced apart recesses.

9. The jewelry product of claim 1 wherein the prongs are disposed vertically relative to the flat surface.

10. The jewelry product of claim 9 including a series of decorative gems and wherein the prongs are arranged between the decorative piece and the series of decorative gems.

11. The jewelry product of claim 1 wherein the circular mounting member has a slanted top wall that is disposed entirely about the decorative piece and is disposed at an acute angle to the flat surface.

* * * * *